United States Patent [19]

Douri

[11] Patent Number: 4,606,487

[45] Date of Patent: Aug. 19, 1986

[54] APPARATUS FOR ATTACHING FASTENERS TO WEB-LIKE MATERIALS

[75] Inventor: Hisashi Douri, Kurobe, Japan

[73] Assignee: Nippon Notion Kogyo Co., Ltd., Tokyo, Japan

[21] Appl. No.: 687,584

[22] Filed: Dec. 28, 1984

[30] Foreign Application Priority Data

Dec. 29, 1983 [JP] Japan ..... 58-199958[U]
Dec. 29, 1983 [JP] Japan ..... 58-199959[U]
Dec. 29, 1983 [JP] Japan ..... 58-199960[U]

[51] Int. Cl.[4] ..... A41H 37/04

[52] U.S. Cl. ..... 227/8; 227/15; 227/18; 227/115; 227/116; 227/119; 227/149

[58] Field of Search ..... 227/1, 2, 8, 15, 30, 227/119, 139, 107, 148, 149, 18, 115, 116

[56] References Cited

U.S. PATENT DOCUMENTS

| | | | |
|---|---|---|---|
| 1,873,890 | 8/1932 | Holmes | 227/18 |
| 3,148,373 | 9/1964 | Effgen | 227/119 |
| 3,632,033 | 1/1972 | Schmidt | 227/18 X |
| 4,247,032 | 1/1981 | Stanik | 227/18 |
| 4,343,423 | 8/1982 | Sauermilch | 227/1 |
| 4,436,238 | 3/1984 | Seki | 227/149 |
| 4,454,650 | 6/1984 | Silver | 227/15 X |

FOREIGN PATENT DOCUMENTS 56-85407 7/1981 Japan .

*Primary Examiner*—Robert L. Spruill
*Assistant Examiner*—Taylor J. Ross
*Attorney, Agent, or Firm*—Hill, Van Santen, Steadman & Simpson

[57] ABSTRACT

An apparatus for attaching a fastener such as a snap closure composed of a first fastener member and a second fastener member to be combined together through a web-like material such as a fabric therebetween, includes a lower pocket mechanism for supporting the second fastener member thereon, a punch mechanism movable toward the lower pocket mechanism for fixing the first fastener member to the second fastener member with the web-like material interposed therebetween, and an upper pocket mechanism for supporting the first fastener member, the upper pocket mechanism being movable toward the lower pocket mechanism and having means for centering the first fastener member in alignment with the second fastener member. A safety mechanism is operatively coupled with the upper pocket mechanism for actuating the punch mechanism only when the upper pocket mechanism reaches a predetermined position with respect to the lower pocket mechanism. A feeder mechanism has first and second hoppers for storing the first and second fastener members therein and first and second pickup means movable rectilinearly for feeding the first and second fastener members out of the first and second hoppers into the first and second pocket mechanisms, respectively.

9 Claims, 18 Drawing Figures

APPARATUS FOR ATTACHING FASTENERS TO WEB-LIKE MATERIALS

BACKGROUND OF THE INVENTION

1. Field of the Invention

The present invention relates to an apparatus for attaching a fastener such as a snap closure, a button, a tack, a rivet, or the like composed of male and female fastener members to a web-like material such as a fabric.

2. Description of the Prior Art

One known apparatus for attaching fasteners of the type described to fabric materials is illustrated in Japanese Laid-Open Patent Publication No. 56-85407. In the disclosed apparatus, a pair of clamps defining a pocket for holding an upper fastener member is mounted on a lower end of a punch holder case, and the clamps are urged toward each other by leaf springs. However, unless the leaf springs apply equal resilient forces to the clamps, the pocket tends to be displaced out of a centered position. When an upper fastener member is to be supplied into the pocket, therefore, it cannot be reliably and smoothly accommodated in the pocket. Furthermore, the upper fastener member in the pocket may not be properly combined with a lower fastener member on a die due to misalignment. According to another known arrangement, a pocket is defined by a pair of clamp members urged by a compression coil spring acting therebetween for gripping a fastener member in the pocket. However, the compression coil spring directly engaging the clamp members may often fail to center the fastener member as desired.

The prior fastener attaching apparatus of the type referred to above includes a punch movable by a drive mechanism such as an air cylinder toward a die for pressing fastener members together. There are known certain safety mechanisms for preventing fingers or tools from being sandwiched between the punch and the die, the examples including a safety cover between the punch and the die and a special safety device associated with the apparatus. However, such prior safety measures have resulted in an increased size of the apparatus, a small field of view in which the operator can visually supervise the operation of the apparatus, and difficulty in removing fastener members from between the punch and the die.

The apparatus shown in Japanese Laid-Open Patent Publication No. 56-85407 includes a parts feeder composed of a conical rotary drum having equally spaced grooves in which base portions of fastener members are fitted. The fastener members can be supplied to a chute by rotating the rotary drum. When dust or machined chips happen to enter grooves in the rotary drum, the fastener members fail to be supplied to the chute or are liable to hit a hopper frame for preventing rotation of the drum. The jamming fastener member has to be removed out of the groove by striking or vibrating the drum. Thus, the apparatus is required to be stopped for removal of such a jam, with the result that the efficiency of the apparatus is lowered. The jam-removing process is also quite tedious and time-consuming.

Another problem is that the rotary drum makes the overall apparatus large in size. It is difficult to position the drum with respect to the chute. When it is found that the drum and chute are improperly positioned with respect to each other, then the chute has to be detached and then positioned again relative to the drum.

SUMMARY OF THE INVENTION

It is an object of the present invention to provide an apparatus for attaching fasteners to web-like materials, the apparatus having means for properly centering a pocket for accommodating a fastener member for smooth and reliable attachment thereof to the web-like material in combination with another fastener member.

Another object of the present invention is to provide an apparatus for attaching fasteners to web-like materials, the apparatus having a safety mechanism for attaching the fastener to the web-like material with increased safety and allowing the operator to keep a wide range of view in visually confirming the attachment of the fastener to the web-like material.

Still another object of the present invention is to provide an apparatus for attaching fasteners to web-like materials, the apparatus having a parts feeder mechanism for reliably and smoothly feeding fastener members to a chute without an unwanted jam.

According to the present invention, there is provided an apparatus for attaching a fastener composed of a first fastener member and a second fastener member to be combined together through a web-like material therebetween, comprising a lower pocket mechanism for supporting the second fastener member thereon, a punch mechanism movable toward the lower pocket mechanism for fixing the first fastener member to the second fastener member with the web-like material interposed therebetween, an upper pocket mechanism for supporting the first fastener member, the upper pocket mechanism being movable toward the lower pocket mechanism and having means for centering the first fastener member in alignment with the second fastener member, a safety mechanism operatively coupled with the upper pocket mechanism for actuating the punch mechanism only when the upper pocket mechanism reaches a predetermined position with respect to the lower pocket mechanism, and a feeder mechanism having first and second hoppers for storing the first and second fastener members therein and first and second pickup means movable rectilinearly for feeding the first and second fastener members out of the first and second hoppers into the first and second pocket mechanisms, respectively.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
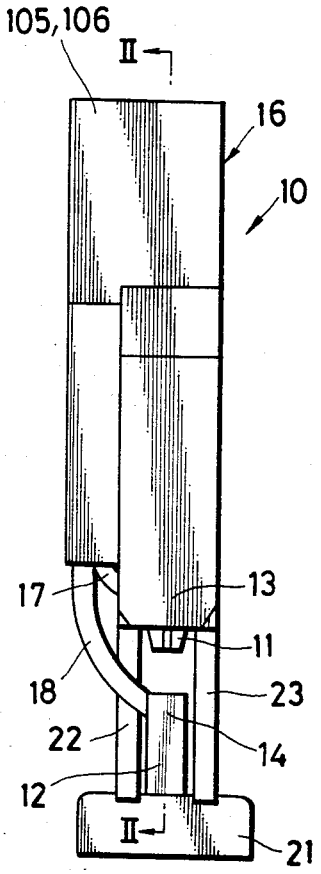
FIG. 1 is a front elevational view of an apparatus for attaching a fastener to a fabric according to the present invention.

The principles of the present invention are particularly useful when embodied in an apparatus 10 for attaching a button to a fabric as shown in FIG. 1. The button to be attached to the fabric is generally composed of an upper female member A (FIG. 7) and a lower male member B to be fitted in and staked on the upper female member A through the fabric F. Examples of such buttons include snap closures, tacks, and other fasteners comprising male and female members which can be combined together when fastened to fabrics or other web-like materials.

The apparatus 10 generally includes an upper pocket mechanism 11 for supporting upper fastener members A one at a time, a lower pocket mechanism 12 for supporting lower fastener members B one at a time, a pusher mechanism 15 (FIG. 2) for pushing the members A, B to the upper and lower pocket mechanisms 11, 12 along a pair of upper and lower guides 13, 14 (FIG. 1), respectively, a parts feeder mechanism 16 for feeding the members A, B down a pair of chutes 17, 18, respectively, a punch mechanism 19 (FIG. 2) for pressing the members A, B together and attaching them to a fabric F (FIG. 5) in sandwiching relation thereto, and a safety mechanism 20 (FIG. 4) operatively coupled to the upper pocket mechanism 11 for providing safety during operation of the apparatus 10. The above mechanisms are mounted on a base 21 and a pair of laterally spaced frames 22, 23 fixed to the base 21.

Figure 2:
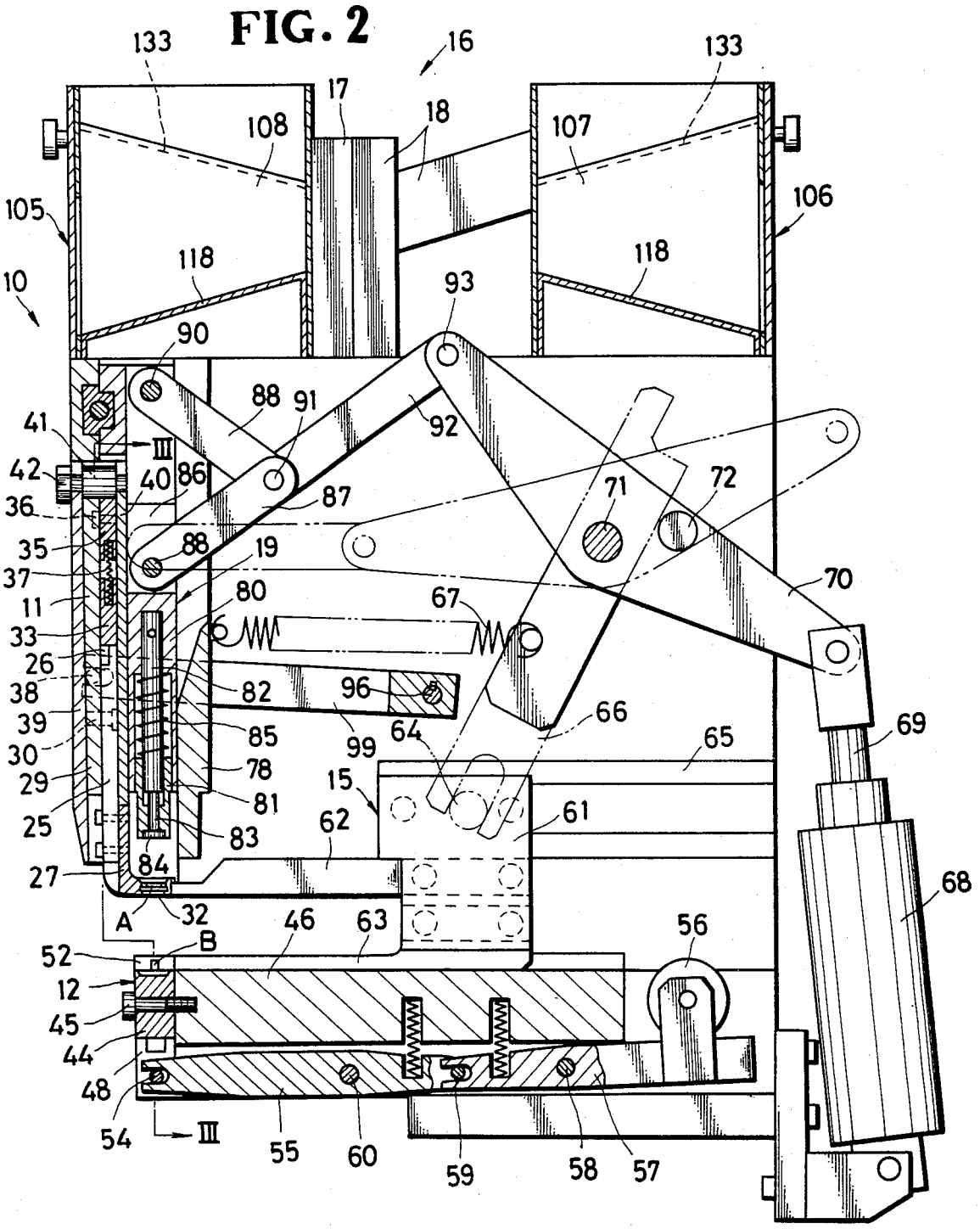
FIG. 2 is an enlarged cross-sectional view taken along line II—II of FIG. 1.
Figure 3:
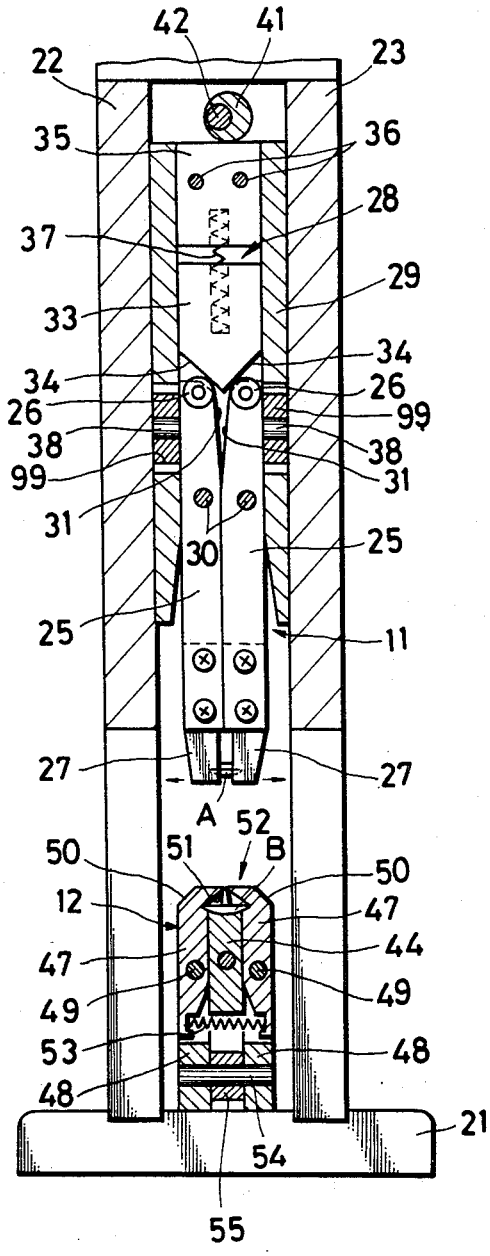
FIG. 3 is a cross-sectional view taken along line III—III of FIG. 2.

As illustrated in FIGS. 2 and 3, the upper pocket mechanism 11 is composed of a pair of pocket holders 25, 25 having a pair of cam followers 26, 26 comprising rollers on upper ends of the holders and a pair of upper pocket members 27, 27 mounted on lower ends of the holders by screws, a presser mechanism 28 for normally urging the cam followers 26, 26 in a direction away from each other, and a slide ram 29 having a channel-shaped cross section.

The pocket holders 25, 25 are angularly movably mounted by a pair of pins 30, 30 in the slide ram 29, and have upper inclined surfaces 31, 31, respectively, confronting each other. The upper pocket members 27, 27 jointly define therebetween a pocket 32 for holding the upper member A.

The presser mechanism 28 comprises a cam plate 33 having a pair of downwardly facing cam surfaces 34, 34 held in contact with the cam followers 26, 26, a spring case 35 disposed above the cam plate 33 and fixed by a pair of screws 36, 36 to the slide ram 29, and a compression coil spring 37 interposed between the cam plate 33 and the spring case 35.

The cam plate 33 is normally urged by the compression coil spring 37 to move downwardly away from the spring case 35 for causing the cam surfaces 34, 34 to press the cam followers 26, 26 apart for laterally spreading the upper ends of the pocket holders 25, 25 away from each other. Thus, the lower ends of the pocket holders 25, 25 are biased to move toward each other for thereby centering the upper pocket 32 defined by the upper pocket members 27, 27. The cam plate 33 is in the form of a tapered plate (FIG. 3) for uniformly biasing the pocket holders 25, 25, but may be of a conical shape especially where the apparatus is large in size.

The slide ram 29 has in its side walls a pair of lift pins 38, 38 engaing a second safety lever 99 (described later) of the safety mechanism 20. As illustrated in FIG. 2, the pocket mechanism 11 is vertically slidable between a guide cover 39 and a spacer plate 40 which are attached to the frames 22, 23.

The upper pocket mechanism 11 as it is moved upwardly is stopped by a stop 41 mounted eccentrically on a stop shaft 42 fixed to and disposed between the guide cover 39 and the spacer plate 40. Angular adjustment of the eccentric stop 41 allows the upper member A to be properly fed along the upper guide 13 by an upper pusher 62 (described later) and reliably held in the upper pocket 32 in the upper pocket members 27, 27.

The lower pocket mechanism 12 includes a die 44 secured by a screw 45 to a die holder 46 for supporting the lower member B, a pair of lower pocket members 47, 47 disposed one on each side of the die 44 and angularly movable about a pair of pins 49, 49, respectively, and a pair of pocket holders 48, 48 coupled to the lower pocket members 47, 47 through the pins 49, 49.

The lower pocket members 47, 47 have on their upper ends a pair of jaws 50, 50 having respective slant surfaces 51, 51 jointly defining a lower pocket 52 therebetween. A compression coil spring 53 is interposed between inner tapered surfaces of the lower ends of the lower pocket members 47, 47 for normally urging the lower pocket members 47, 47 to turn about the pins 49, 49 in a direction to grip the lower member B between the jaws 50, 50.

A holder pin 54 extends transversely between lower portions of the pocket holders 48, 48 and engages an end of a swing lever 55.

When the pusher mechanism 15 is retracted, a cam follower 56 comprising a roller is depressed to turn a roll lever 57 clockwise (FIG. 2) about a pin 58. At this time, the swing lever 55 is caused by a pin 59 to turn counterclockwise about a pin 60 for thereby lowering the pocket holders 48, 48 and the lower pocket members 47, 47. As the lower pocket members 47, 47 are lowered, the slant surfaces 51, 51 of the jaws 50, 50 slidably contact a peripheral edge of the lower member B and are spread apart to widen the lower pocket 52 against the force of the compression coil spring 53.

As shown in FIG. 2, the pusher mechanism 15 comprises a pusher holder 61 having the upper pusher 62 and a lower pusher 63 which are vertically spaced and the pusher holder also having a roller pin 64, the pusher holder 61 being slidable along the die holder 46 and engagable with the cam follower 56. The pusher mechanism 15 also includes a guide 65 along which the pusher holder 61 is slidable back and forth (leftward and rightward in FIG. 2), and a pusher lever 66 engaging the roller pin 64 and pivotably mounted on a lever pin 71 extending between the frames 22, 23. The pusher lever 66 is normally urged by a tension spring 67 in a direction to move toward the punch mechanism 19.

The punch mechanism 19 is driven by an air cylinder 68, as is described later on. When the air cylinder 68 is actuated, its piston rod 69 is raised to turn a main lever 70 to cause a pin 72 thereon to push the pusher lever 66 counterclockwise about the lever pin 71, thereby retracting the pusher mechanism 15 along the guide 65 against the force of the tension spring 67.

Figure 8:
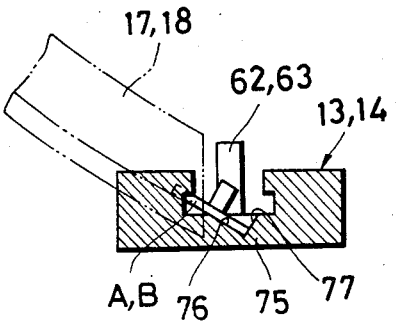
FIG. 8 is a fragmentary cross-sectional view of a guide.
Figure 9:
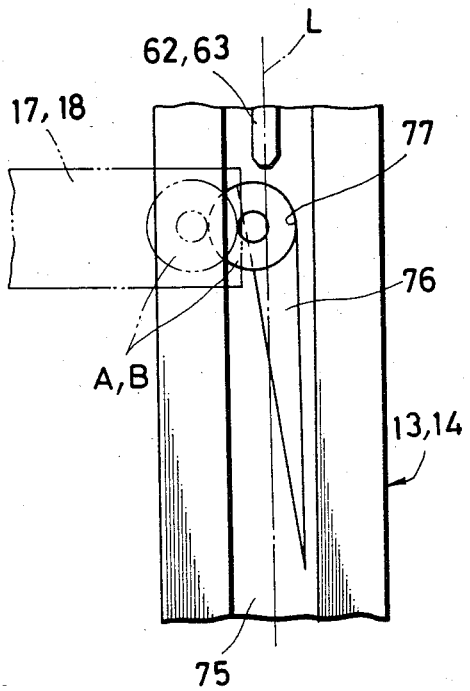
FIG. 9 is a fragmentary plan view of the guide shown in FIG. 8.

As illustrated in FIGS. 8 and 9, each of the upper and lower guides 13, 14 is of a channel-shaped cross section including a bottom 75 having a substantially V-shaped groove 76 defined in an upper surface thereof. The groove 76 is deepest at an end thereof connected to the chute 17, 18 and is progressively shallower toward an opposite end or the pocket mechanism 11, 12. The member A, B as it is placed from the chute 17, 18 into the deepest end of the groove 76 is pushed by the pusher 62, 63 along the groove 76. When the member A, B is thus pushed, it is gradually turned into a horizontal position on its way into the pocket mechanism 11, 12.

The groove 76 has a stop wall 77 positioned such that when the member A, B is fed from the chute 17, 18 onto the guide 13, 14, the center of the member A, B is displaced off a central line L of the guide 13, 14. The member A, B discharged out of the chute 17, 18 is stopped by the stop wall 77 before the member A, B is pushed by the pusher 62, 63.

If adjacent members A or B are partially overlapped at their flanges, as shown in FIG. 9, only the member A, B placed on the guide 13, 14 is pushed by the pusher 62, 63 which is positioned out of alignment with the center of the member A, B. Therefore, the members A or B are fed reliably one by one into the pocket mechanism 11, 12.

Figure 5:
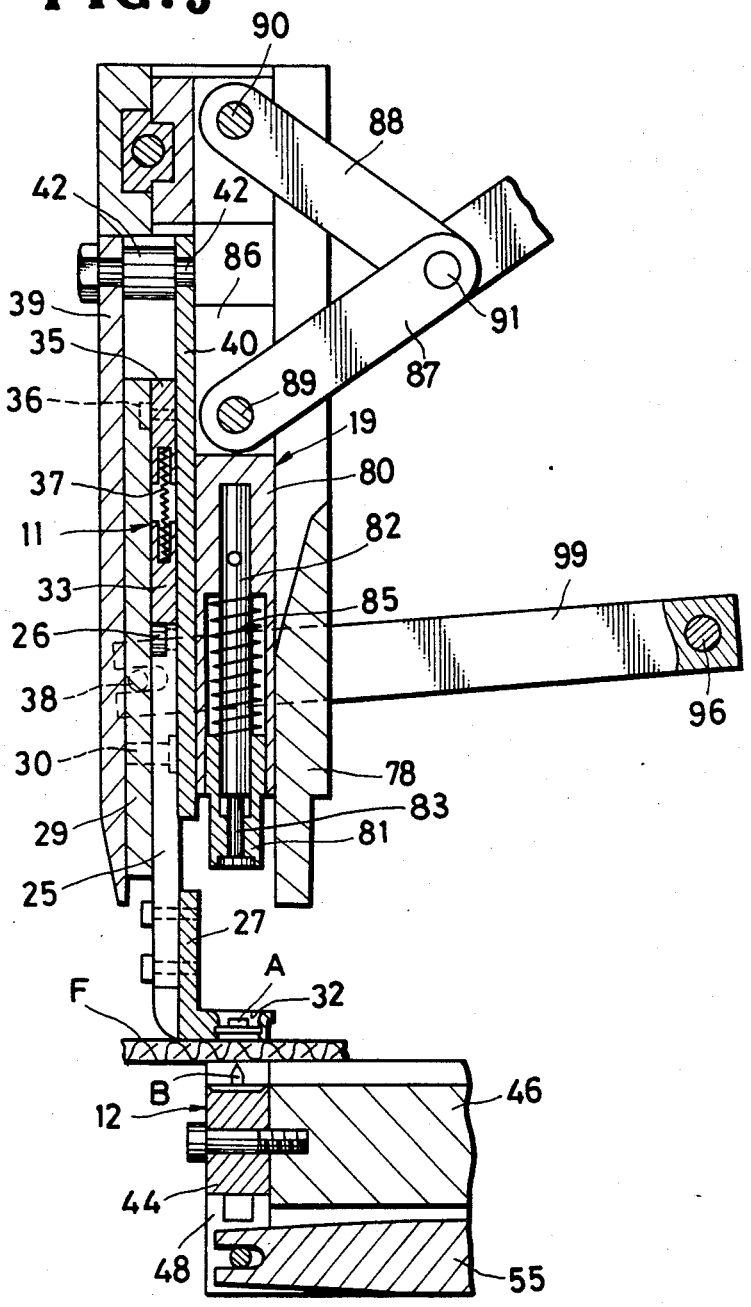
FIG. 5 is a fragmentary cross-sectional view showing an upper pocket mechanism as it is lowered.
Figure 6:
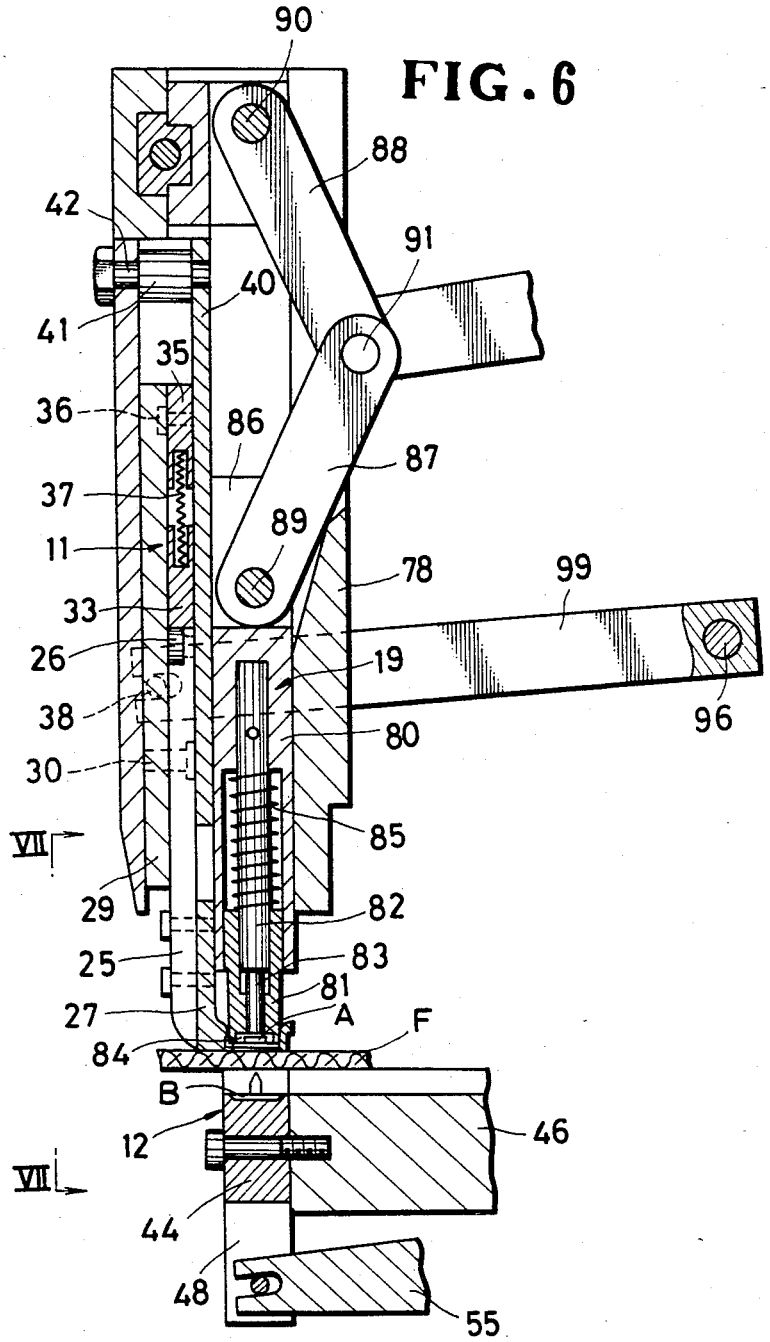
FIG. 6 is a fragmentary cross-sectional view showing a punch mechanism as it is lowered.

As illustrated in FIG. 5, the punch mechanism 19 comprises a punch case 80 opening downwardly and slidably disposed between the spacer plate 40 and a punch guide 78, a punch holder 81 slidably fitted in a lower open end thereof, and a rod-shaped punch 82 having an upper end fixedly mounted in the punch case 80 and a lower end 83 inserted in the punch holder 81. The punch holder 81 has a downwardly opening recess 84 (FIG. 6). A compression coil spring 85 is interposed between the punch case 80 and the punch holder 81 for normally urging the punch holder 81 downwardly.

The punch case 80 has on an upper end thereof a bifurcated flange 86. A pair of toggle links 87, 88 is operatively coupled between the frames 22, 23 and the punch case 80. More specifically, the toggle link 87 is pivotably connected by a pin 89 to the bifurcated flange 86 of the punch case 80, and the toggle link 88 is pivotably connected by a pin 90 to the frames 22, 23. The toggle links 87, 88 are pivotably connected to each other by a pin 91 mounted on an end of a link 92 (FIG. 2) which is pivotably connected by a pin 93 on the other end to the main lever 70. Therefore, when the piston rod 69 of the air cylinder 68 is lifted, the toggle links 87, 88 are spread away from each other to lower the punch case 80.

Figure 4:
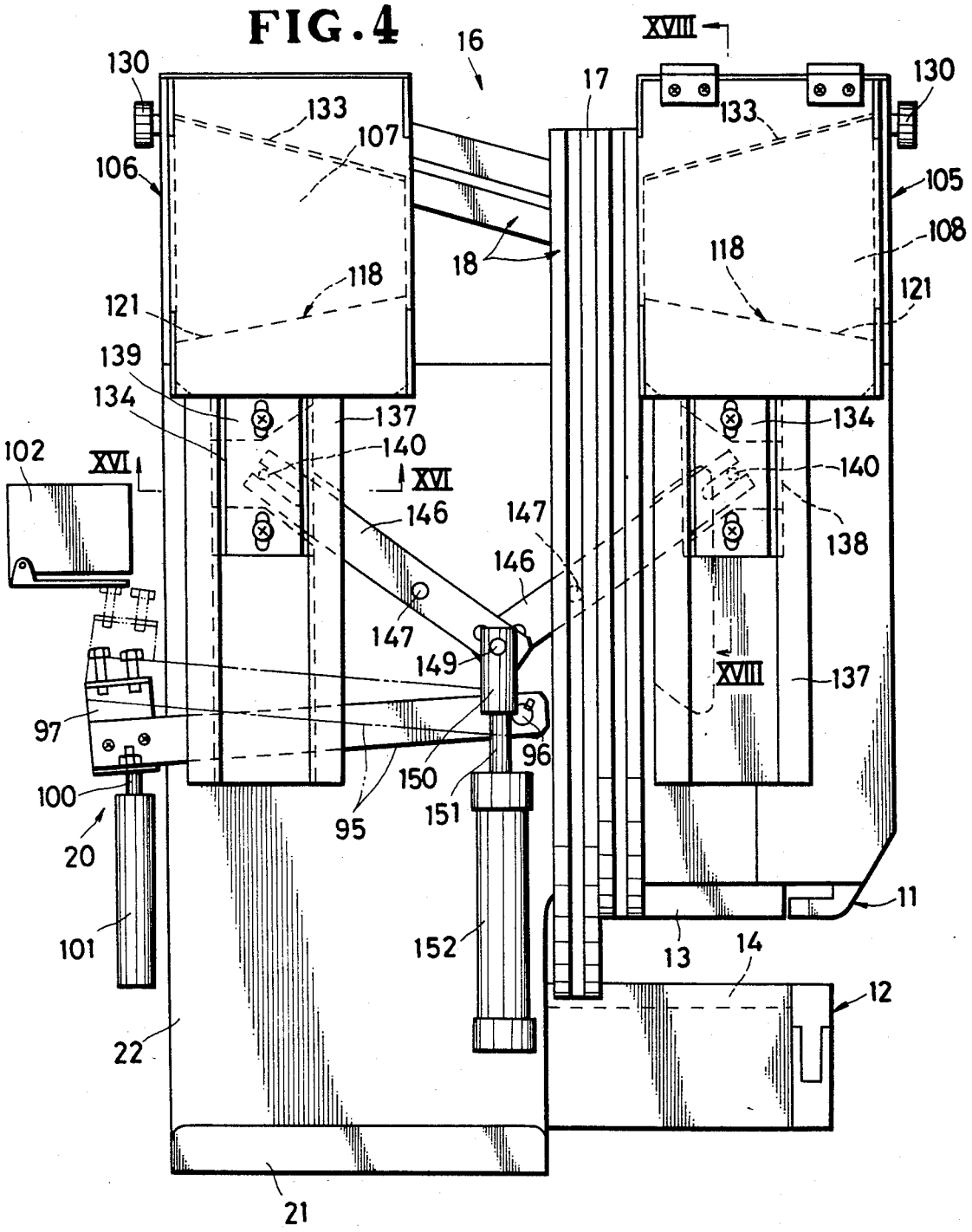
FIG. 4 is a lefthand side elevational view of the apparatus of FIG. 1.

As shown in FIG. 4, the safety mechanism 20 includes a first safety lever 95 connected at one end to a lever shaft 96 pivotably mounted on the frames 22, 23 and supporting on the other end a sensor bracket 97, and the second safety lever 99 (FIG. 2) fixed at one end to the lever shaft 96 and having a bifurcated configuration with the other end engaging the pins 38 on the slide ram 29. The safety mechanism 20 also has an air cylinder 101 having a piston rod 100 attached to the sensor bracket 97, and a sensor switch 102 comprising a limit switch, for example, disposed above the sensor bracket 97 and actuatable in response to engagement therewith.

The air cylinder 101 is normally actuated to urge the piston rod 100 thereof to move downwardly to cause the first and second safety levers 95, 99 to keep the upper pocket mechanism 11 in an upper position as shown in FIG. 2 under normal or inoperative condition.

When a switch (not shown) is turned on after the members A, B have been positioned with respect to the fabric F, the air cylinder 101 is vented to release the piston rod 100. Then, the upper pocket mechanism 11 falls due to gravity (FIG. 5). As the upper pocket mechanism 11 moves downwardly, the second safety lever 99 is turned counter-clockwise (FIG. 5) to turn the lever shaft 96, whereupon the first safety lever 95 is turned clockwise in FIG. 4 to bring the sensor bracket 97 into engagement with the sensor switch 102. The sensor switch 102 now generates a signal to drive the punch mechanism 19. The air cylinder 68 is actuated to project the piston rod 69 for thereby lowering the punch mechanism 19 as shown in FIG. 6.

In operation, the members A, B to be fastened on the fabric F are fed down the chutes 17, 18, respectively, from the parts feeder mechanism 16 and delivered by the pusher mechanism 15 into the upper and lower pockets 32, 52. Since the upper pocket members 27, 27 have to be spread away from each other at this time, the resilient force of the tension spring 67 of the pusher mechanism 15 is required to be larger than the resilient force of the compression coil spring 37 of the presser mechanism 28. Therefore, the pocket holders 25, 25 are turned about the pins 30, 30 to open the upper pocket 32, and the cam followers 26, 26 are moved toward each other to displace the cam plate 33 upwardly against the downward force of the compression coil spring 37.

When the upper member A is completely accommodated in the upper pocket 32, it is firmly gripped by the pocket members 27, 27 since they tend to come together under the force of the compression coil spring 37.

Figure 7:
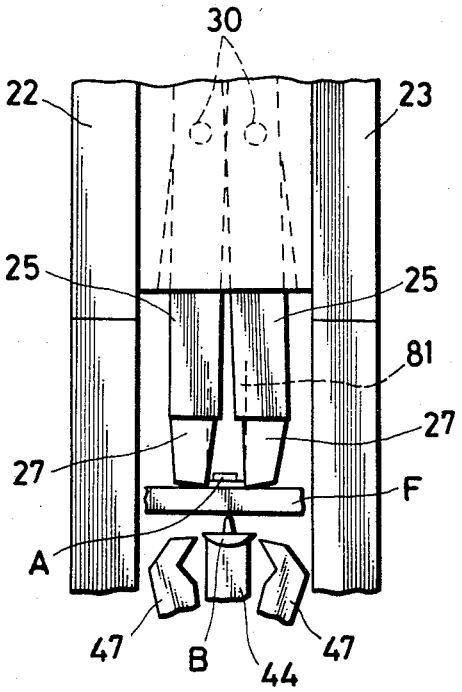
FIG. 7, appearing with FIG. 1, is an elevational view taken along line VII—VII of FIG. 6.

Then, the fabric F is positioned with respect to the fastener members A, B, and the switch is turned on to inactivate the air cylinder 101 for releasing the safety mechanism 20, whereupon the air cylinder 68 is actuated as described above to lower the punch mechanism 19. The lower end of the punch holder 82 is lowered into the upper pocket 32 to spread the upper pocket members 27, 27, as shown in FIG. 7, whereupon the lower end 83 of the punch 82 is moved downwardly to press the upper member A against the lower member B on the die 44 with the fabric F therebetween until the members A, B are coupled together by staking.

The presser mechanism 28 acting on the upper pocket mechanism 11 is effective in centering the upper pocket 32 in alignment with the lower pocket 52 for attaching the fastener members A, B accurately and smoothly to the fabric F. The cam plate 33 and the spring case 35 of the presser mechanism 28 are in the form of plates which make the presser mechanism 28 thin and compact in size, with the result that the overall apparatus is rendered compact in size.

Should there be any foreign matter such as a finger present between the upper and lower pocket mechanisms 11, 12, the upper pocket mechanism 11 is prevented thereby from going down, and the sensor bracket 97 does not engage the sensor switch 102. Therefore, no signal is generated by the sensor switch 102 and the punch mechanism 19 is not lowered. The foreign matter placed between the upper and lower pocket mecahnisms 11, 12 is only subjected to the weight of the upper pocket mechanism 11, and will not be damaged severely. Since the upper pocket mechanism 11 is operatively coupled with the safety mechanism 20 to serve as a sensor probe, no special sensor probe is required to be provided, an arrangement which allows the operator to easily confirm the position in which to attach the fastener members A, B to the fabric F.

The parts feeder mechanism 16 is described in detail with reference to FIGS. 4 and 10 through 18.

Figure 11:
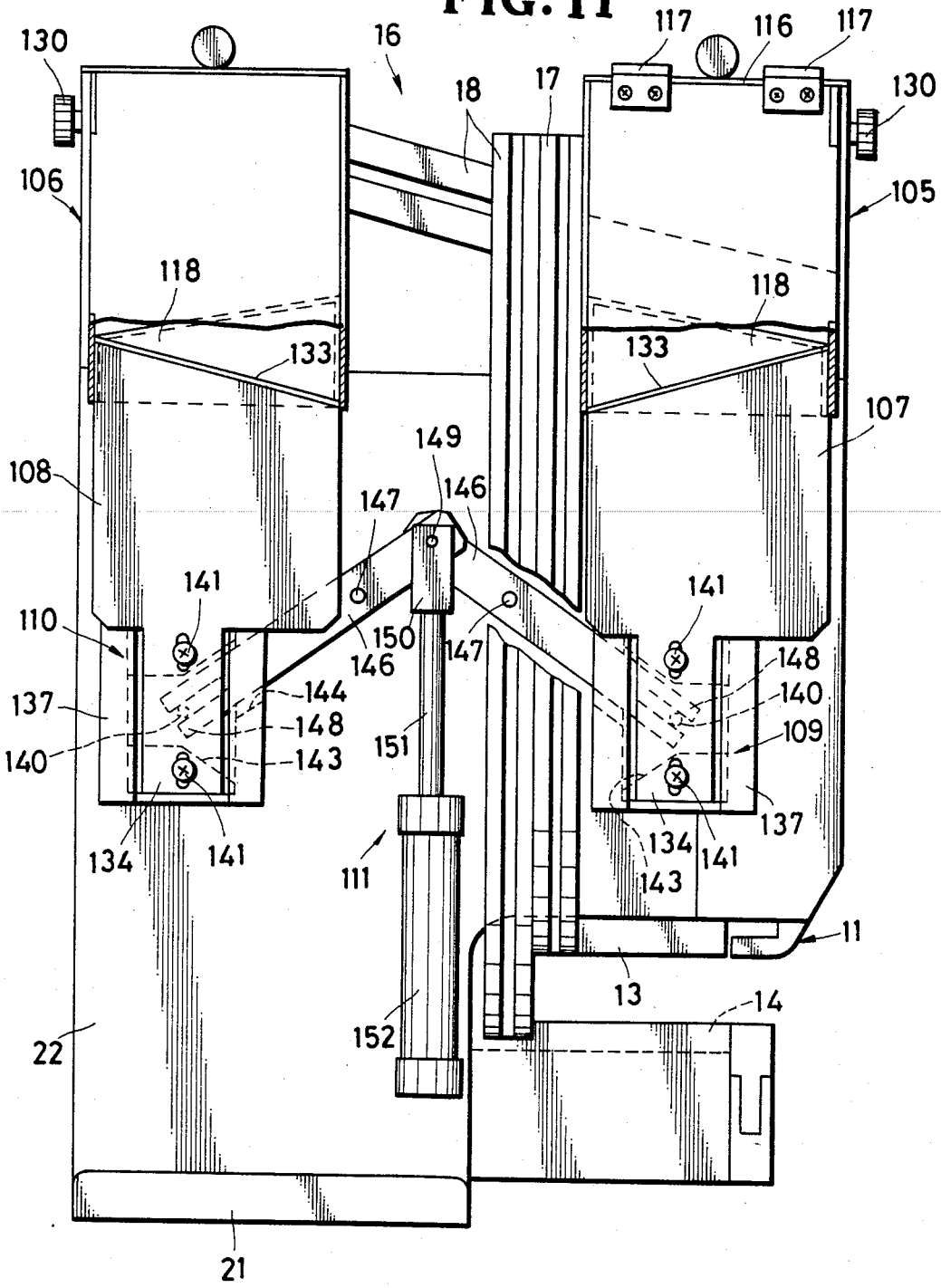
FIG. 11 is a righthand side elevational view of the apparatus of FIG. 1.

As shown in FIGS. 4 and 11, the parts feeder mechanism 16 is composed of a first hopper 105 for containing a multiplicity of the upper fastener members A, a second hopper 106 for containing a multiplicity of the lower fastener members B, a pair of first and second pickup blades 107, 108 movable vertically in the first and second hoppers 105, 106, respectively, for picking up fastener members A, B and feeding them into the chutes 17, 18, a pair of first and second slides 109, 110 in which the first and second pickup blades 107, 108 are vertically slidable, and a driver mechanism 111 for vertically moving the first and second pickup blades 107, 108.

Figure 12:
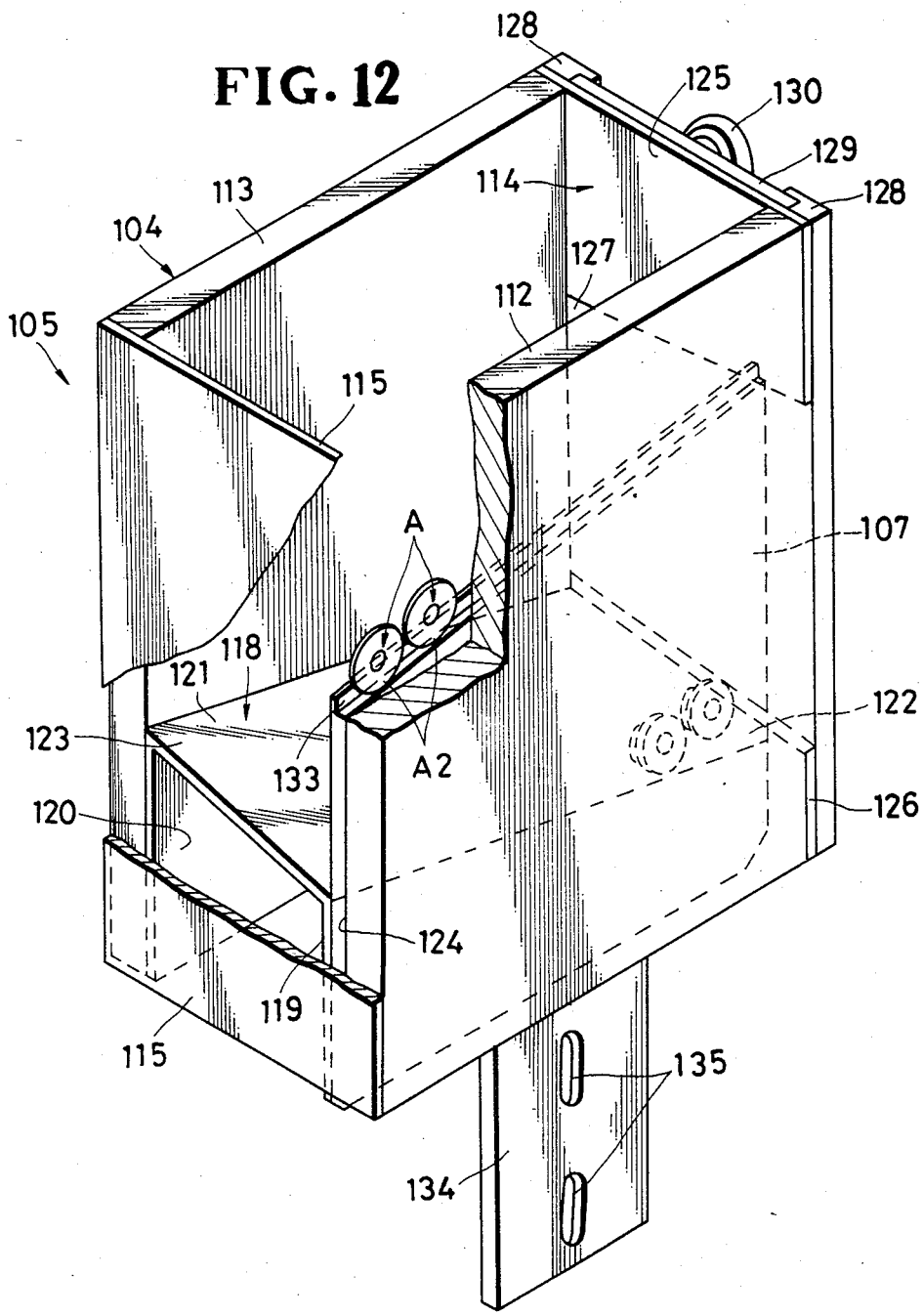
FIG. 12 is a perspective view, partly broken away, of a hopper and a pickup blade in the parts feeder mechanism.
Figure 13:
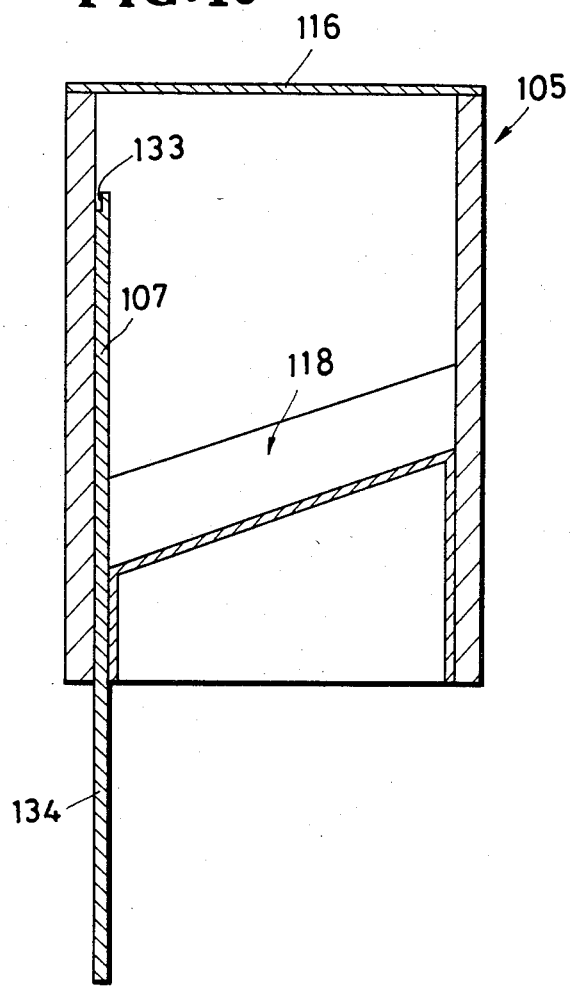
FIG. 13 is a cross-sectional view of the hopper and the pickup blade.
Figure 18:
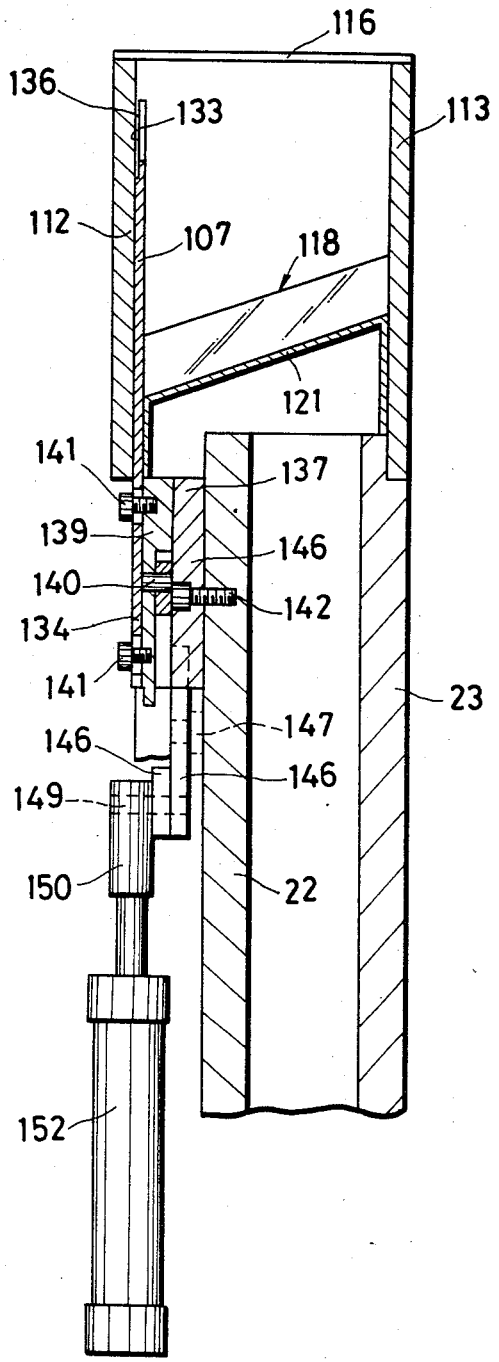
FIG. 18, appearing with FIG. 15, is a cross-sectional view taken along line XVIII—XVIII of FIG. 4.

FIG. 12 shows the first hopper 105 and the first pickup blade 107 in greater detail. The second hopper 106 and the second pickup blade 108 are not described in detail as they are the mirror images of the first hopper 105 and the first pickup blade 107. The first hopper 105 is in the form of a box 104 composed of a pair of spaced side panels 112, 113, a pair of front and rear covers 114, 115 attached to opposite edges of the side panels 112, 113. A lid plate 116 (FIGS. 11, 13, and 18) is openably mounted by hinges 117 to the upper end of the box 104. A parts tray 118 is disposed in a lower portion of the box 104 as a bottom of the hopper 105 and has spaced legs 119, 120 and an integral upper plate 121. The leg 120 is higher than the leg 119, and they are progressively lower toward the front cover 114, so that the upper plate 121 is inclined downwardly toward a lowest corner 122. The parts tray 118 has a highest corner 123 located in diagonally opposite relation to the lowest corner 122. Therefore, the fastener members A contained in the hopper 105 tend to move toward the lowest corner 122 due to gravity. The leg 119 is spaced from the side panel 112 to define a gap 124 in which the pickup plate 107 is vertically movable.

Figure 10:
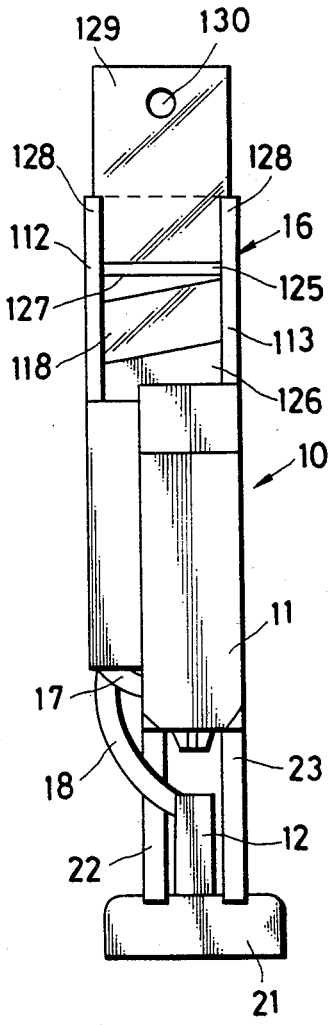
FIG. 10 is a front elevational view of the apparatus with a transparent plate of a parts feeder mechanism being lifted.

The front cover 114 is composed of an upper cover member 125 and a lower cover member 126 spaced therefrom to define an opening 127 therebetween. The lower cover member 126 has an upper edge extending along the inclined surface of the upper plate 121 of the parts tray 118. As shown in FIGS. 10 and 12, a transparent panel 129 having a knob 130 is vertically slidably disposed against an outer surface of the front cover 114 and retained by a pair of rails 128, 128. The transparent panel 129 as it is in a lowest position covers the opening 127 and allows the operator to visually check the rate at which the fastener members A are fed out of the hopper 105. When the transparent panel 129 is pulled upwardly to uncover the opening 127, the fastener members A can be removed from the hopper 105 or new fastener members A can be stored into the hopper 105.

Figure 14:
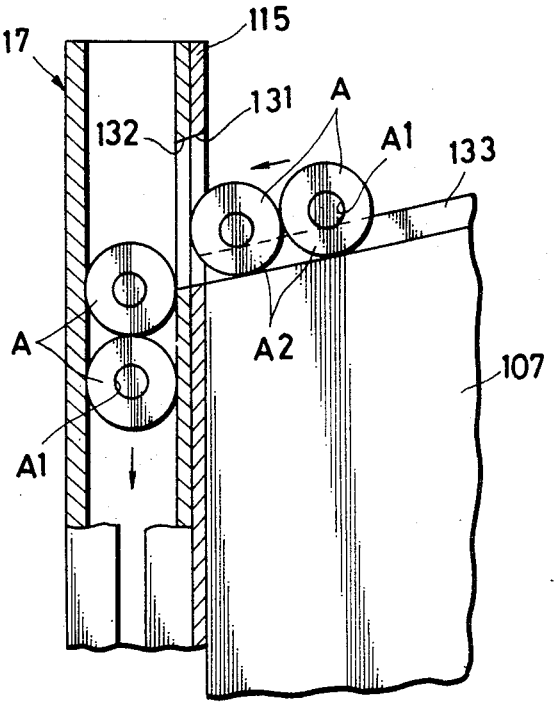
FIG. 14, appearing with FIG. 10, is a fragmentary cross-sectional view of the pickup blade and a chute, showing the manner in which fastener members are fed from the pickup blade into the chute.

As shown in FIG. 14, the rear cover 115 has a hole 131 defined therein for delivering therethrough the fastener members A picked up by the pickup blade 107, and the chute 17 also has a hole 132 in registry with the hole 131.

Figure 15:
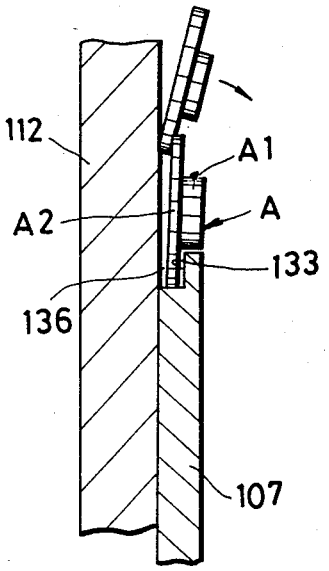
FIG. 15 is a fragmentary cross-sectional view of the pickup blade retaining a fastener member guided by a channel.

As illustrated in FIG. 12, the pickup blade 107 has an upper edge inclined downwardly toward the chute 17 and having a recess 133 and an integral lower tongue 134 having oblong holes or slots 135 defined therein. As shown in FIG. 15, each fastener member A has a central base portion Al and a flange A2 extending radially outwardly from the central base portion Al. The recess 133 opens toward the side panel 112 to define a channel 136 in which the flanges of the fastener members A are loosely fitted. The lower tongue 134 of the pickup blade 107 is vertically adjustably fastened to the slide 109 by screws 141 extending through the slots 135.

Figure 16:
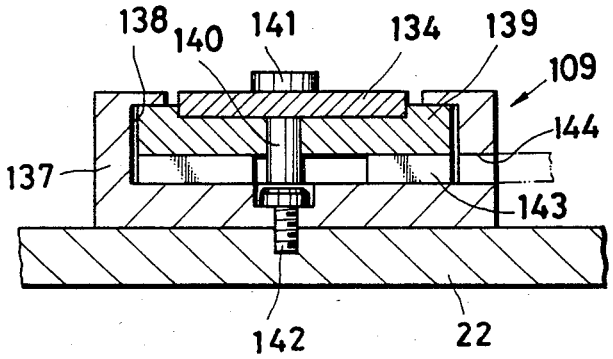
FIG. 16 is a cross-sectional view taken along line XVI—XVI of FIG. 4.
Figure 17:
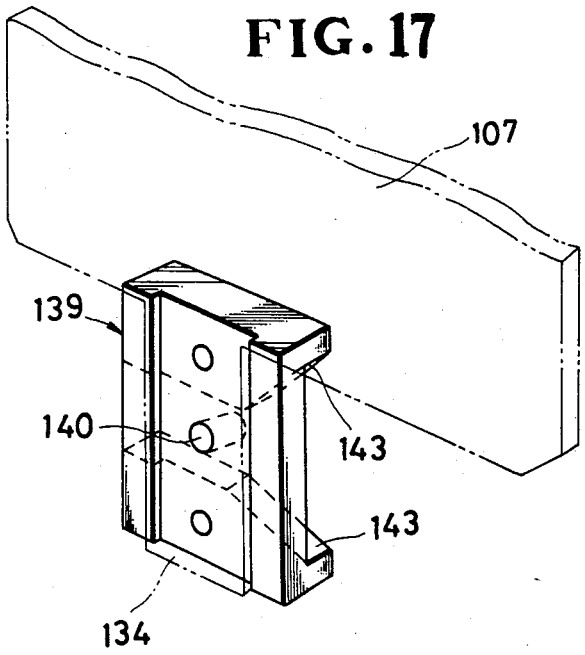
FIG. 17 is a perspective view of a slide block.

As shown in FIGS. 16 and 17, the slide 109 has a channel-shaped slide guide 137 fixed by screws 142 to the frame 22, and a slide block 139 vertically slidably disposed in a guide channel 138 in the slide guide 137. The slide block 139 has a central pin 140 and inclined surfaces 143, 143 diverging away from each other in a direction away from the pin 140. The tongue 134 of the pickup blade 107 is fastened to a front surface of the slide block 139. The slide guide 137 has an opening 144 in its side wall.

As shown in FIG. 11, the driver mecahnism 111 has a pair of first and second lift levers 146, 146 pivotably mounted by a pair of pins 147, 147, respectively, on the frame 22 and having ends engaging the pins 140, 140 of the slide blocks 139, 139 and opposite ends pivotably coupled by a pin 149 to a joint 150 connected to a piston rod 151 of an air cylinder 152. The lift levers 146, 146 extend through the openings 144, respectively, in the slide guides 137, 137.

Operation of the parts feeder mechanism 16 is as follows:

When the air cylinder 152 is actuated to lift the piston rod 151, the first and second lift levers 146, 146 are turned about the pins 147, 147 to cause the slide blocks 139, 139 to slide downwardly in the guide channels 138, 138. The first and second pickup blades 107, 108 are lowered until the higher ends of the upper inclined edges thereof reach the lowest corners 122, 122 of the parts tray 118, 118 as shown in FIG. 11. The pickup blades 107, 108 thus lowered pick up certain fastener members A, B with their flanges fitted in the channels 136, 136, in which the fastener members A, B roll toward the chutes 17, 18. Any fastener member overlapped or sandwiched between the side panel 112 and a fastener member fitted in the channel 136 as shown in FIG. 15 will drop onto the parts tray 118 when the fastener member in the channel 136 rollingly moves.

When the piston rod 151 is lowered, the pickup blades 107, 108 are moved upwardly to allow the fastener members A, B picked up thereby to be delivered through the holes 131, 132 (FIG. 14) into the chutes 17, 18.

Since the fastener members A, B are fed into the chutes 17, 18 by vertical straight-line motion of the pickup blades 107, 108 in the hoppers 105, 106, the fastener members A, B can reliably and smoothly be delivered into the chutes 17, 18 without being jammed in the hoppers 105, 106. The parts feeder mechanism 16 is relatively simple in construction, free from failures, and makes the apparatus more compact than would be if circular rotary drums were used for parts storage.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for attaching a fastener composed of a first fastener member and a second fastener member to be combined together through a web-like material therebetween, comprising:

(a) a lower pocket mechanism for supporting the second fastener member thereon;

(b) a punch mechanism movable toward said lower pocket mechanism for fixing the first fastener member to the second fastener member with the web-like material interposed therebetween;

(c) an upper pocket mechanism for supporting the first fastener member, said upper pocket mechanism being movable toward said lower pocket mechanism and having means for centering the first fastener member in alignment with the second fastener member, said supper pocket mechanism including a slide ram, a pair of pocket holders pivotably mounted on said slide ram and defining a first pocket in ends thereof, said pocket holders having a pair of cam followers on opposite ends thereof, said means for centering comprising a presser mechanism including a cam plate slidably disposed in said slide ram and having cam surfaces engaging said cam followers, respectively, and spring means for normally urging said cam plate in a direction to cause said cam surfaces and said cam followers to turn said pocket holders to close said first pocket;

(d) a safety mechanism operatively coupled with said upper pocket mechanism for actuating said punch mechanism only when said upper pocket mechanism reaches a predetermined position with respect to said lower pocket mechanism; and (e) a feeder mechanism having first and second hoppers for storing the first and second members therein and first and second pickup means movable rectilinearly for feeding the first and second fastener members out of said first and second hoppers into said first and second pocket mechanism, respectively.

2. An apparatus according to claim 1, said presser mechanism further including a spring case fixedly mounted in said slide ram, said spring means comprising a compression coil spring acting between said spring case and said cam plate for normally urging said cam plate against said cam followers.

3. An apparatus according to claim 2, said presser mechanism further including an eccentric cam engaging said slide ram for positionally adjusting the same.

4. An apparatus according to claim 1, further including a pusher mechanism having a pair of first and second pushers normally biased for guiding the first and second fastener members from said feeder mechanism into said first and second pocket mechanisms.

5. An apparatus according to claim 4, including a mechanism for actutating said punch mechanism, said pusher mechanism being retractable to move said first and second pushers away from said first and second pocket mechanisms in response to operation of said actuating mechanism.

6. An apparatus according to claim 1, said safety mechanism comprising a first safety lever fixed at one end on a pivotable shaft and having a sensor bracket on an opposite end, a second safety lever having one end fixed to said pivotable shaft and an opposite end operatively coupled with said first pocket mechanism, and a sensor switch engageable by said sensor bracket for producing a signal to drive said punch mechanism.

7. An apparatus according to claim 1, said first and second hoppers having first and second trays having inclined upper plates, said first and second pickup means comprising first and second pickup blades vertically movably disposed in said first and second hoppers, respectively, and having upper inclined edges defining channels for feeding the first and second fastener members therealong, further including first and second chutes connected to said first and second hoppers, respectively, for receiving the first and second fastener members from said channels of said first and second pickup blades.

8. An apparatus according to claim 7, each of said first and second hoppers comprising a box including spaced side panels, each of said first and second trays having spaced legs, one of said legs being spaced from one of said side panels to define a gap therebetween in which one of said pickup blades is vertically slidable.

9. An apparatus according to claim 8, each of said first and second hoppers further including spaced covers, one of which has a first hole, each of said first and second chutes having a second hole registered with said first hole.

* * * * *